United States Patent [19]

Kunzmann

[11] 4,094,500

[45] June 13, 1978

[54] APPARATUS FOR THE FOLDING OF PAPER WEBS OR SIMILAR MATERIALS

[75] Inventor: Otto Kunzmann, Neuffen, Germany

[73] Assignee: Bielomatik Leuze & Co., Neuffen, Germany

[21] Appl. No.: 736,800

[22] Filed: Oct. 29, 1976

[30] Foreign Application Priority Data

Nov. 12, 1975 Germany ..... 2550759

[51] Int. Cl.[2] ..... B65H 45/20

[52] U.S. Cl. ..... 270/79; 270/73

[58] Field of Search ..... 270/79, 61 F, 73

[56] References Cited

U.S. PATENT DOCUMENTS

| | | | |
|---|---|---|---|
| 3,124,350 | 3/1964 | Huffman | 270/79 |
| 3,912,252 | 10/1975 | Stephens | 270/79 |

FOREIGN PATENT DOCUMENTS

| | | | |
|---|---|---|---|
| 1,002,623 | 8/1965 | United Kingdom | 270/79 |

*Primary Examiner*—Edgar S. Burr
*Assistant Examiner*—A. Heinz
*Attorney, Agent, or Firm*—J. Rodman Steele, Jr.

[57] ABSTRACT

The present specification describes and claims an apparatus for the folding of paper webs or similar materials for the formation of a stack made up of folded layers. The apparatus has a laying arm adapted to perform a reciprocating motion while laying out the layers to form the stack, and at least one folding screw which, in use, is located in the region of a corner of the stack. The folding screw is arranged with its axis extending substantially vertically to the plane of the layers and with its leading edge entering from the side of the stack between layers to be folded. The at least one folding screw is adapted to rotate twice for each reciprocating cycle of the laying arm and a pressing-down element is arranged to, in use, act upon the top layer succeeding the last fold, so as to be effective on the top layer in the region where the leading edge of the folding screw enters in between the layers.

20 Claims, 6 Drawing Figures

APPARATUS FOR THE FOLDING OF PAPER WEBS OR SIMILAR MATERIALS

Figure 1:
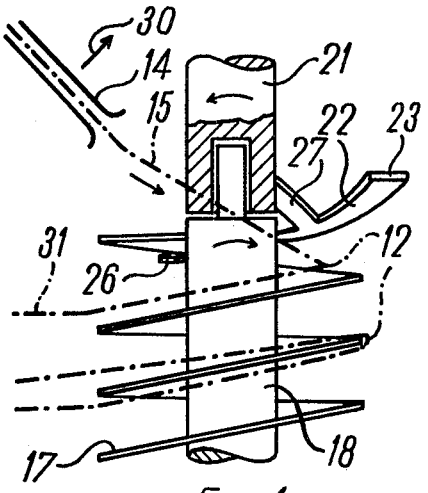

The present invention relates to an apparatus for the folding of paper webs or similar materials for the formation of a stack made up of folded layers.

In particular, the present invention relates to apparatus of the type having a reciprocating laying arm and at least one folding screw which, in use, is located in the region of a corner of the stack with its axis extending substantially vertically to the plane of the layers, and with its leading edge entering from the side of the stack between the layers to be folded, the at least one folding screw being adapted to rotate twice for each reciprocating cycle of the laying arm and a pressing-down element acting upon the top layer succeeding the fold.

A folding apparatus of the type referred to hereabove is known, for example, from German Offenlegungschrift No. 2,443,798. The folding screws in this apparatus are each provided on their leading edges with a brush, which is intended for smoothing out the fold. On an axis extending parallel to the fold across the stack, beaters are arranged which act upon the fold from the outside and co-operate to aid the formation of the fold. In this apparatus the stack is formed vertically, i.e. the individual layers in the stack lie parallel to the earth surface. Hence the laying out of the sheets occurs primarily under the influence of the force of gravity.

If the rate of operation of the folding apparatus is to be increased and/or, for reasons of space, the stack is to be given a different direction of stacking, difficulties will arise with this type of apparatus. The placing of the stack into an oblique position is very desirable in order to diminish the total height of the machine. As a result, though, the influence of the force of gravity is diminished, so that any regular and undisturbed work, in particular at higher folding rates, is prevented.

It is therefore, an aim of the present invention to provide a folding apparatus of the aforementioned type which ensures operationally safe working with the stack in an oblique position and/or at high operating speeds.

According to the present invention there is provided an apparatus for the folding of paper webs or similar materials for the formation of a stack made up of folded layers, comprising a laying arm adapted to perform a reciprocating motion, whilst laying out the layers to form the stack, and at least one folding screw which, in use, is located in the region of a corner of the stack with its axis extending substantially vertically to the plane of the layers and with its leading edge entering from the side of the stack between layers to be folded, the at least one folding screw being adapted to rotate twice for each reciprocating cycle of the laying arm, and a pressing-down element being arranged, in use to act upon the top layer succeeding the last fold, so as to be effective on the top layer in the region where the leading edge of the folding screw enters in between the layers.

The present invention safely ensures that the folding screw on entering into the stack does not engage underneath the top folded layer due to the latter not having been as yet lowered sufficiently far. This would lead not only to the folding screw being unable to support the subsequent fold from the inside, and so possibly causing a fold to be made at the wrong place, but the paper web would then also extend over two threads of the screw and break. The present invention safequards that such faults leading to a breakdown cannot occur.

Figure 2:
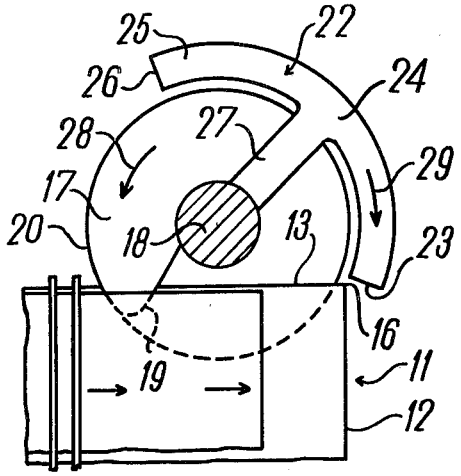
Figure 3:
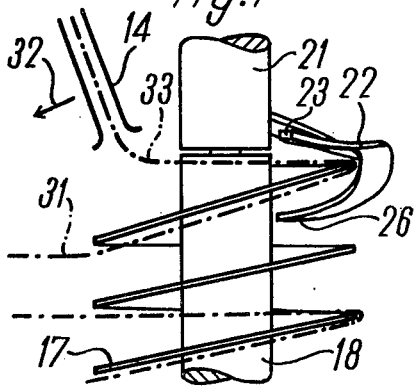
Figure 4:
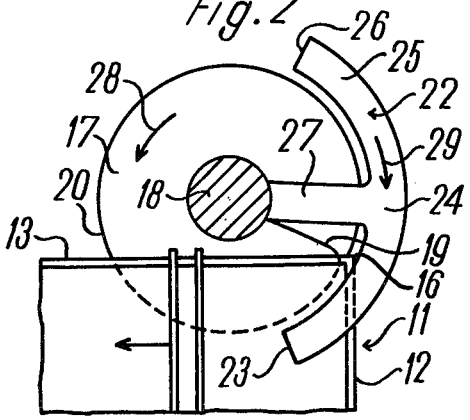
Figure 5:
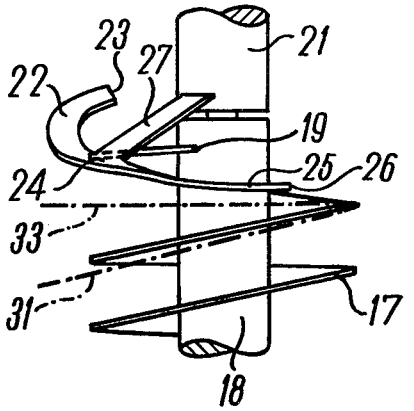
Figure 6:
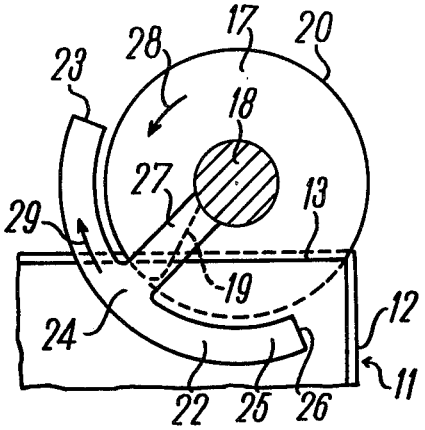

The present invention will now be further described, by way of example, with reference to the accompanying drawings, in which:

FIG. 1 schematically illustrates in a partial side elevation, a corner of a stack of folded layers together with one embodiment of apparatus according to the present invention, in a first working position;

FIG. 2 is a plan view corresponding to FIG. 1;

FIG. 3 schematically illustrates in a partial side elevation the arrangement of FIGS. 1 and 2 in a second working position;

FIG. 4 is a plan view corresponding to FIG. 3;

FIG. 5 schematically illustrates in a partial side elevation, the arrangement of FIGS. 1 and 2 in a third working position; and FIG. 6 is a plan view corresponding to FIG. 5.

In the accompanying drawings a corner of a stack 11 of folded layers, made up, for example, from a pre-perforated or pre-embossed paper web, is shown. The folded edges 12 as viewed in the drawings face towards the right, whilst the lateral edge 13 of each layer, as viewed in FIGS. 2, 4 and 6, faces upwards. The layers may consist of paper or some other flat material which is unwound as a single sheet or in several layers from a roll or the like and after some processing, if necessary, is to be formed into a folded stack.

For laying the individual layers in the stack, a laying arm 14, also referred to as a folding sleeve, is provided which is arranged so that it can perform a reciprocating, usually an oscillating, movement. The laying arm 14 guides the material web 15 so that the web is in effect zigzagged (see FIGS. 1, 3 and 5). In the region of the corner 16 of the stack a folding screw 17 is arranged. The folding screw 17 comprises a shaft 18 arranged vertically with respect to the planes of the layers in the stack, with helicoidal surfaces wound spirally around the shaft and attached thereto. The folding screw 17 has in the region of its leading edge 19 (uppermost in the drawings) a pitch, which in the downwardly succeeding threads diminishes to a constant, relatively small value. As can be seen from FIGS. 2, 4 and 6, the folding screw is arranged so that its shaft 18 rotates close to the lateral edge 13 of the stack, with its circumference 20 extending to the corner 16 where the folding edge 12 and the lateral edge 13 meet. The circumference 20 thus supports the folding edge 12 from inside the fold.

Co-axially to the shaft 18 of the folding screw is arranged a shaft 21, which is driven independently of the shaft 18 and carries a pressing-down element 22. This element 22 comprises, in the embodiment illustrated in the drawings, an arc-shaped, flat strip which measures about 135° on the circumference, and is arranged at a small distance outside the circumference 20 of the folding screw. The strip forming the pressing-down element 22 is provided with a helical pitch which does not have a constant value. The strip has a large pitch in the region of the leading edge 23, this region forming a funnel-shaped inlet, and has a flatter pitch in the middle region 24, the pitch increasing again slightly in the rear region 25 and flattening out again at the end 26. This particular shape will depend, however on the particular condition of each individual device and may be varied within a wide range. If desired the strip can be constructed with a constant value pitch.

The pressing-down element 22, formed by the arc-shaped strip, is connected via a radially arranged bridge 27 to the shaft 21. The bridge extends over the folding screw so that the pressing-down element can rotate independently of the folding screw 17. It is evident, however from FIGS. 1, 3 and 5 that the rear region 25 of the pressing-down element overlaps in the axial direction, the top region of the folding screw, the pitch of the folding screw running in the opposite direction to that of the pressing-down element. The folding screw is driven via its shaft 18 in the direction of the arrow 28, i.e. anti-clockwise, whilst the pressing-down element 22 is driven by the co-axial shaft 21 in clockwise direction, i.e. in the direction of the arrow 29. The pitches, however, are adapted so that they both have a downwards direction of conveying, i.e. towards the stack. The folding screw normally has a length of a few threads so as to guide the upper portion of the stack. Then the now correctly folded layers drop out of the folding screw at the bottom and place themselves freely on the succeeding portion of the stack.

The shafts 18 and 21 are driven from the same drive, i.e. they are synchronized with one another, but shaft 18 has in its direction of rotation, indicated by arrow 28, twice the rotational frequency of the shaft 21; arrow 29 indicates the rotational direction of shaft 21. The rotation frequency 29 corresponds to the frequency of the laying arm 14, i.e. at every reciprocating movement of the laying arm 14, the pressing-down element 22 performs a complete revolution in the clockwise direction and in the same period of time the folding screw 17 performs two revelutions in the anticlockwise direction.

The apparatus according to the present invention as shown in the accompanying drawings, operates as follows:

The web 15 issuing from the laying arm 14 guiding the paper web is conveyed in the position according to FIGS. 1 and 2, in the direction towards the righthand folding edge shown. For this purpose, in FIGS. 1 and 2, the laying arm 14 moves in the direction of the arrow 30, i.e. towards the folding edge 12. When the laying arm 14 is shortly before its righthand point of reversal in its oscillating movement (as viewed in FIG. 1), then the leading edge 19 of the folding screw 17 enters from the lateral edge 13 into the stack in the process of formation, in such a way that the leading edge 19 of the folding screw 17 extends over that particular layer 31 which the laying arm 14 has just laid out. It is this layer which is just about to be folded to form the folding edge 12.

In FIGS. 3 and 4 a succeeding working position is shown, wherein the laying arm 14 has already passed its righthand extremity of the oscillation and has just commenced its oscillating movement towards the left in the direction of the arrow 32. The leading edge 19 has then reached the corner 16, so that the circumference 20 of the top thread of the folding screw now supports the folded edge 12 and maintains the topmost layer in its desired position. The layer 33 of the material succeeding the folded edge in an upwards direction, is then drawn by the laying arm 14 towards the left whilst circumference 20 engages within folded edge 12.

It will be observed, that the pressing-down element 22 with its leading edge 23 has already moved from the outside over and past the folding edge 12, over the topmost layer 33, so that this layer is well retained between the upper thread of the folding screw and the pressing-down element so as to fix the folding edge.

In FIGS. 5 and 6 a succeeding working position can be seen, wherein the laying arm, not shown in these figures, is nearing its lefthand point of reversal. Hence the working position according to FIGS. 5 and 6 is shifted by half a period in respect of that of FIGS. 1 and 2. Consequently the leading edge 19 of the folding screw is again in the same position as in FIGS. 1 and 2. This time, however, it passes over the layer 33 succeeding the layer 31. The pressing-down element 22 ensures that this occurs in each case with adequate certainty, because the element 22 extends with its middle to rear region 24, 25 over the layer 33, and presses the same down to such an extent that the leading edge 19 is certain to pass over it. It has already been mentioned, that for this reason the rear region 25 overlaps the leading edge 19 in the axial direction, i.e. it is further advanced in the direction of the stack than the leading edge 19.

With regard to the synchronization of the rotational movements of the folding screw 17 and the pressing-down element 22 it should be noted that during the formation of the fold, i.e. when the laying arm 14 moves away again from the folded egde, the folding screw 17 should be inside the folding edge and the pressing-down element 22 above the top layer 33. The pressing down of this top layer 33 should have occurred when the leading edge 19 of the folding screw passes again over this top layer and should be maintained, if possible, up to this moment.

Although numerous possibilities exist for the arrangement of the pressing-down element, the arrangement co-axially to the folding screw with a circular path around the diameter of the folding screw is particularly advantageous. In special cases it is also possible, however, to foresee a displacement of the axes or the arrangement of intersecting axes. The realization of the pressing-down element, as well as of the folding screw, with a non-constant pitch, adapted to the particular requirements, improves the performance. In particular the opening of the helix in the front range helps to ensure the picking up of each layer and the accurate location of the layer in the right position. The described overlapping of the rear section 25 of the pressing-down element 22 in respect of the leading edge 19 of the folding screw forcibly ensures that the leading edge 19 on entering passes over the top layer 33. The angular range comprised by the segment-shaped pressing-down element 22 may vary within wide limits. An angle between 90° and 180° however, has proved particularly advantageous.

In the accompanying drawings, only one corner of the stack is shown and for the sake of simplicity of presentation the stack is shown with a vertical direction of stacking. The device is particularly well suited, however, to be used for stacking arrangements with an inclined stack axis. Thus, for example, with an inclination of the stack axis of 60°, where in fact the plane of the layers departs by only approx. 30° from the vertical, a considerable saving in space in the overall machine can be achieved whilst, thanks to the advantages of the invention, an undisturbed, folded laying out of the layers can be achieved.

Normally, apparatus as shown in the accompanying drawings will be used at all four corners. This is particularly important in the upper corners of oblique stacks, because here the tendency of the individual layers to lift, is particularly great.

I claim:

1. An apparatus for the folding of paper webs or similar materials for the formation of a stack made up of folded layers, comprising:

an arm for laying out the layers to form the stack, the laying arm being adapted for substantially cyclical, oscillatory motion, each of said layers being formed by one half-cycle of said cyclical motion, successive topmost layers being formed during each of said half-cycles as said webs leave said arm, each of said topmost layers having an upper surface directed away from said stack;

at least one folding screw which, in use, is located in the region of a corner of the stack having an axis of rotation extending substantially perpendicularly to the plane of the layers and having a leading edge for first engaging said webs, the leading edge entering the stack from the inside thereof between layers to be folded, the at least one folding screw being adapted to rotate twice for each said oscillatory cycle of the laying arm;

means for rotating the at least one folding screw in one direction; and a pressing-down element mounted for rotation in the opposite direction to the at least one folding screw about an axis of rotation extending substantially perpendicularly to the plane of the layers and arranged to act upon each of said upper surfaces, so as to vertically position the web below the leading edge of the at least one folding screw, in the region where the leading edge enters in between the layers, the at least one folding screw preventing movement of the folded layers toward the middle of the stack.

2. An apparatus in accordance with claim 1, wherein the pressing-down element is arranged co-axially with the at least one folding screw.

3. An apparatus in accordance with claim 1, wherein the pressing-down element is provided with a pitch which is effective towards the stack.

4. An apparatus in accordance with claim 3, wherein the pressing-down element includes an obliquely placed segment.

5. An apparatus in accordance with claim 4, wherein the pressing-down element has an arc-shaped form and a driving shaft, and at least one bridge section connecting the arc-shaped form to the driving shaft.

6. An apparatus in accordance with claim 4, wherein the pressing-down element extends peripherally in a range between one-half and one-quarter of the circumference of the at least one folding screw.

7. An apparatus in accordance with claim 3, wherein the pressing-down element includes a segment shaped like a screw section.

8. An apparatus in accordance with claim 7, wherein the pressing-down element has an arc-shaped form and a driving shaft, and at least one bridge section connecting the arc-shaped form to the driving shaft.

9. An apparatus in accordance with claim 3, wherein the pressing-down element has an incoming forward section and wherein the pitch of the pressing-down element is non-constant, the pitch being steeper at the incoming section.

10. An apparatus in accordance with claim 9, wherein the pressing-down element has an arc-shaped form and a driving shaft, and at least one bridge section connecting the arc-shaped form to the driving shaft.

11. An apparatus in accordance with claim 1, wherein part of the pressing-down element partly overlaps the at least one folding screw in the axial direction.

12. An apparatus in accordance with claim 11, wherein the pressing-down element has an arc-shaped form and a driving shaft, and at least one bridge section connecting the arc-shaped form to the driving shaft.

13. An apparatus in accordance with claim 1, wherein the pressing-down element is arranged to rotate on a path encircling the at least one folding screw.

14. An apparatus in accordance with claim 13, wherein the pressing-down element has an arc-shaped form adn a driving shaft, and at least one bridge section connecting the arc-shaped form to the driving shaft.

15. An apparatus in accordance with claim 1, wherein the pressing-down element has a forward incoming section and is synchronized with the folding screw such that the incoming section passes over each of said upper surfaces before the leading edge of the folding screw moves inside the folded layers of the stack.

16. An apparatus in accordance with claim 1, wherein the pressing-down element has forward, middle and rear sections as seen in the direction of movement, and is synchronized with the at least one folding screw so that when the leading edge of the at least one folding screw enters a fold, the middle or rear section of the pressing-down element is entering into the fold.

17. An apparatus in accordance with claim 16, wherein said middle or rear section is axially closer to the stack than the leading edge of the at least one folding screw.

18. An apparatus in accordance with claim 1, wherein the pressing-down element rotates at half the rotational frequency of the at least one folding screw.

19. An apparatus for folding paper webs or similar materials for the formation of a stack made up of folded layers, comprising:

an arm for laying out the layers to form the stack, the laying arm being adapted for substantially cyclical, oscillatory motion;

at least one folding screw which, in use, is located in the region of a corner of the stack having an axis of rotation extending substantially perpendicularly to the plane of the layers and having a leading edge which enters the stack from the inside thereof between layers to be folded, the at least one folding screw being adapted to rotate twice for each said oscillatory cycle of the laying arm;

means for rotating the at least one folding screw in one direction; and, a pressing-down element arranged, in use, to act upon the top layer succeeding the last fold, so as to be effective on the top layer in the region where the leading edge of the at least one folding screw enters in between the layers, the pressing-down element arranged to rotate in the opposite direction to the at least one folding screw.

20. An apparatus in accordance with claim 19, wherein the pressing-down element rotates at half the rotational frequency of the at least one folding screw.

* * * * *